US009308144B2

(12) United States Patent
Derringer

(10) Patent No.: US 9,308,144 B2
(45) Date of Patent: Apr. 12, 2016

(54) WHEELCHAIR SAFETY DEVICE

(71) Applicant: Mike Derringer, Greenwood, IN (US)

(72) Inventor: Mike Derringer, Greenwood, IN (US)

( * ) Notice: Subject to any disclaimer, the term of this patent is extended or adjusted under 35 U.S.C. 154(b) by 0 days.

(21) Appl. No.: 14/684,537

(22) Filed: Apr. 13, 2015

(65) Prior Publication Data

US 2015/0290056 A1 Oct. 15, 2015

Related U.S. Application Data

(60) Provisional application No. 61/978,325, filed on Apr. 11, 2014.

(51) Int. Cl.
*A61G 5/10* (2006.01)
*A61G 5/14* (2006.01)

(52) U.S. Cl.
CPC ..... *A61G 5/101* (2013.01); *A61G 5/1018* (2013.01); *A61G 5/1029* (2013.01); *A61G 5/1035* (2013.01); *A61G 5/14* (2013.01); *A61G 2005/1089* (2013.01)

(58) Field of Classification Search
CPC ..... A61G 5/101; A61G 5/14; A61G 5/1018; A61G 5/1035; A61G 5/1029; A61G 2005/1089; B62B 5/04; B62B 5/0404; B62B 5/0409; B62B 5/049; B60T 7/02; B60T 7/08
See application file for complete search history.

(56) References Cited

U.S. PATENT DOCUMENTS

| | | | | |
|---|---|---|---|---|
| 4,019,752 | A * | 4/1977 | Leon | A61G 3/0808 188/2 F |
| 4,934,725 | A | 6/1990 | Owens | |
| 4,948,156 | A | 8/1990 | Fortner | |
| 5,322,312 | A * | 6/1994 | Cammack | A61G 5/025 280/11.115 |
| 5,358,266 | A * | 10/1994 | Roth | A61G 5/02 188/2 F |
| 5,984,334 | A | 11/1999 | Dugas | |
| 6,352,138 | B1 | 3/2002 | Duran | |
| 6,793,232 | B1 | 9/2004 | Wing | |
| 7,694,990 | B2 * | 4/2010 | Goertzen | A61G 5/02 280/288.4 |
| 8,998,244 | B2 | 4/2015 | Purdue | |
| 2010/0133770 | A1 * | 6/2010 | Mims | B62B 5/085 280/47.34 |

* cited by examiner

*Primary Examiner* — Paul N Dickson
*Assistant Examiner* — Darlene P Condra
(74) *Attorney, Agent, or Firm* — Robert Gray; The Gray Law Group, Ltd

(57) ABSTRACT

A wheelchair safety device transfers the weight of an entering or exiting user into a brake and stop against the rear wheel and floor, ensuring stability during the transfer. The device may be installed on one or both of the rear wheels of the wheelchair, and provides a handle which will bear the user's full weight with complete stability during the transfer. When not in use, the brake is disengaged, the floor stop is fully retracted to enable complete maneuverability of the wheelchair, and the handle also retracts.

12 Claims, 1 Drawing Sheet

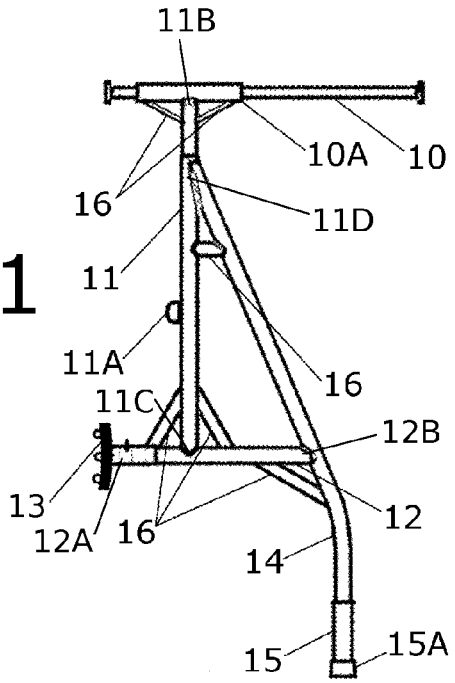
FIG.1
FIG.2
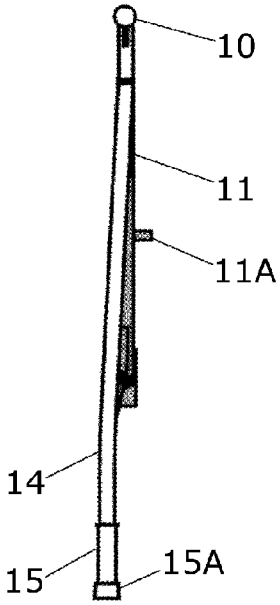
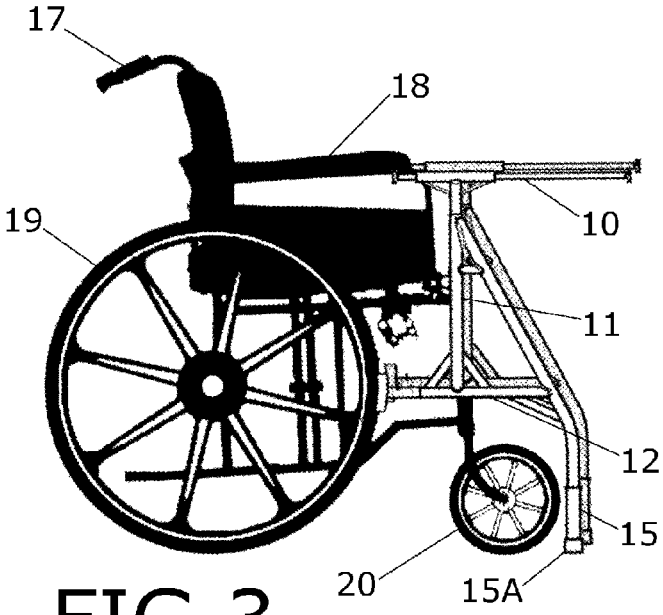
FIG.3
FIG.4
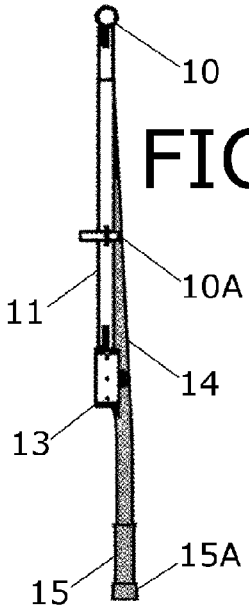

WHEELCHAIR SAFETY DEVICE

CROSS-REFERENCE TO RELATED APPLICATIONS

This application claims the benefit of U.S. Provisional Application No. 61/978,325 filed Apr. 11, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to wheelchairs and related devices and in particular to a wheelchair safety device. For those who use wheelchairs, transferring into and out of the wheelchair can be very nerve-wracking. Although all modern wheelchairs have brakes, they are inadequate to prevent the wheelchair from sliding across the floor with the brakes engaged, or tipping over and falling forward. Such events occur more frequently with larger, heavier users and endanger their ability to live independently. Ideally, a mechanism would be installed which counters the user's size and weight, maintaining the wheelchair in a stable position, and ensuring that the user may enter and exit the wheelchair without difficulty or assistance. A wheelchair safety device, which transfers the weight of the entering or exiting user into a brake and stop against the rear wheel and floor, would resolve this problem.

SUMMARY OF THE INVENTION

Accordingly, the invention is directed to a wheelchair safety device. The device transfers the weight of an entering or exiting user into a brake and stop against the rear wheel and floor, ensuring stability during the transfer. The device may be installed on one or both of the rear wheels of the wheelchair, and provides a handle which will bear the user's full weight with complete stability during the transfer. When not in use, the brake is disengaged, the floor stop is fully retracted to enable complete maneuverability of the wheelchair, and the handle also retracts.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 is a side view of the first exemplary embodiment, displaying the handle 10, the tube 10A, the shaft 11, the pivot element 11A, the shaft top connection point 11B, the shaft bottom connection point 11C, the second shaft top connection point 11D, the horizontal member 12, the rear end of the horizontal member 12A, the front end of the horizontal member 12B; the brake 13, the diagonal member 14, the stop 15, the pad 15A, and the struts 16.

FIG. 2 is a front view of the first exemplary embodiment, displaying the handle 10, the shaft 11, the pivot element 11A, the diagonal member 14, the stop 15, and the pad 15A.

FIG. 3 is a side view of the first exemplary embodiment installed on a wheelchair, displaying the handle 10, the shaft 11, the horizontal member 12, the stop 15, the pad 15A, the wheelchair 17, the arm rest 18, the rear wheel 19, and the front wheel 20.

FIG. 4 is a rear view of the first exemplary embodiment, displaying the handle 10, the tube 10A, the shaft 11, the pivot element 11A, the brake 13, the diagonal member 14, the stop 15, and the pad 15A.

DETAILED DESCRIPTION OF THE INVENTION

Referring now to the invention in more detail, the invention is directed to a wheelchair safety device. The device transfers the weight of an entering or exiting user into a brake 13 and stop 15 against the rear wheel 19 and floor, ensuring stability during the transfer. The device may be installed on one or both of the rear wheels 19 of the wheelchair 17, and provides a handle 10 which will bear the user's full weight with complete stability during the transfer. When not in use, the brake 13 is disengaged, the floor stop 15 is lifted to enable complete maneuverability of the wheelchair 17, and the handle 10 also retracts.

It is to be understood that while the first exemplary embodiment is intended for use with wheelchairs, this is not intended as a limitation. The invention may be used with any wheeled conveyance with a short wheelbase which may require the substantial shifting of the weight of a passenger or other load, relative to the counterbalancing weight of the wheeled conveyance, during entry and exit via one end of the wheeled conveyance.

The first exemplary embodiment provides a structure which is pivotally mounted on one or both outer sides of the wheelchair 17 about a locking pivot element 11A, which is forward and above relative to the center of the rear wheel 19. The structure pivots slightly in a vertical plane with the rear wheel 19. Affixed centrally to the pivot element 11A is a shaft 11, which is affixed to a horizontal member 12 at the shaft bottom connection point 11C. Mounted at the rear end of the horizontal member 12 is a rear wheel brake 13, such that the brake 13 may be angled off of or on to the rear wheel 19 to apply braking force. The shaft 11 also extends upward from the pivot element 11A, terminating in the shaft top connection point 11B at about the level of the wheelchair armrest 18.

Extending forward and downward from the second shaft top connection point 11C is a diagonal member 14. The diagonal member 14 is affixed to the front end 12B of the horizontal member 12. The diagonal member 12 terminates in a floor stop 15; the diagonal member 14 is configured to engage the stop 15 with the floor in front of the front wheel 20, at the same degree of pivot that the brake 13 engages with the rear wheel 19. The stop 15 provides a small, flexible pad 15A at its lower end to prevent damage to the floor.

Affixed above the connection point is a tube 10A containing a slidable handle 10. The handle 10 is preferably cylindrical and may be freely slid forward within the tube 10A to a use position or backward to a storage position. In the storage position, the weight of the handle 10 causes the handle 10 to pivot rearward and the brake 13 and stop 15 to pivot up and forward, thus releasing the brake 13 and stop 15. Optionally, the stop 15 may be capable of being retracted a short distance, such as three inches, into the diagonal member 14 and locked in the retracted position. In the use position, the weight of the handle 10 causes the handle 10 to pivot forward and the brake 13 and stop 15 to pivot rearward and engage with the rear wheel 19 and floor, respectively.

In the use position during entry and exit of the wheelchair 17, the user places his or her body weight on the handle 10, thus transferring the user's body weight into additional brake and stop force, ensuring stability. The shaft 11 is vertical in the use position, and the diagonal member 14 also slopes outward slightly relative to the centerline of the wheelchair 17, providing additional strength and stability. Struts 16 are affixed to and reinforce the connections from the tube 10A to the shaft 11, the shaft 11 to the horizontal member 12, and the diagonal member 14 to the horizontal member 12, further strengthening the design. Accessories such as a leg rest, or a tabletop which may be temporarily mounted across the handles 10, are also contemplated and may be provided separately.

To use the first exemplary embodiment, the user unlocks the pivot element 10A on each device and rotates each device into the use position, then extends the handles 10 and the stops 15, locking them into position. The user then locks the pivot elements 11A, places his or her hands on the handles 10, and transfers into the wheelchair. The user may then retract the handles 10 and the stops 15, locking them into position, and rotates each device into the storage position, locking the pivot element 10A.

The handle 10, the tube 10A, the shaft 11, the pivot element 11A, the horizontal member 12, the diagonal member 14, the stop 15, and the struts 16 are preferably manufactured from rigid, durable, corrosion resistant materials with substantial structural strength, such as stainless steel and aluminum alloy. The brake 13 and the pad 15A are preferably manufactured from a flexible, durable material, such as rubber or silicone. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A wheelchair safety device comprising:

(a) a handle;

(b) a tube;

(c) said handle being cylindrical;

(d) said handle being slidably disposed within said tube;

(e) a shaft;

(f) said tube being affixed to said shaft at a shaft top connection point;

(g) a horizontal member;

(h) said horizontal member being affixed to said shaft at a shaft bottom connection point;

(i) a pivot element;

(j) said pivot element being affixed centrally to said shaft;

(k) a brake;

(l) said brake being affixed to a rear end of said horizontal member;

(m) a diagonal member;

(n) said diagonal member being affixed to said shaft at a second shaft top connection point;

(o) said diagonal member being affixed to a front end of said horizontal member;

(p) said diagonal member terminating in a floor stop.

2. The wheelchair safety device of claim 1 further comprising a wheelchair; said wheelchair having a rear wheel; said pivot element being affixed to said wheelchair such that said brake is engageable with said rear wheel.

3. The wheelchair safety device of claim 2 wherein said wheelchair has an armrest, and wherein said shaft top connection point is about level with said armrest.

4. The wheelchair safety device of claim 3 wherein said floor stop has affixed at its lower end a flexible pad.

5. The wheelchair safety device of claim 4 further comprising a plurality of struts; said plurality of struts being affixed to and reinforcing one or more of the connections between: (i) said tube and said shaft; (ii) said shaft and said horizontal member; or (iii) said horizontal member and said diagonal member.

6. The wheelchair safety device of claim 3 further comprising a plurality of struts; said plurality of struts being affixed to and reinforcing one or more of the connections between: (i) said tube and said shaft; (ii) said shaft and said horizontal member; or (iii) said horizontal member and said diagonal member.

7. The wheelchair safety device of claim 2 wherein said floor stop has affixed at its lower end a flexible pad.

8. The wheelchair safety device of claim 7 further comprising a plurality of struts; said plurality of struts being affixed to and reinforcing one or more of the connections between: (i) said tube and said shaft; (ii) said shaft and said horizontal member; or (iii) said horizontal member and said diagonal member.

9. The wheelchair safety device of claim 2 further comprising a plurality of struts; said plurality of struts being affixed to and reinforcing one or more of the connections between: (i) said tube and said shaft; (ii) said shaft and said horizontal member; or (iii) said horizontal member and said diagonal member.

10. The wheelchair safety device of claim 1 wherein said floor stop has affixed at its lower end a flexible pad.

11. The wheelchair safety device of claim 10 further comprising a plurality of struts; said plurality of struts being affixed to and reinforcing one or more of the connections between: (i) said tube and said shaft; (ii) said shaft and said horizontal member; or (iii) said horizontal member and said diagonal member.

12. The wheelchair safety device of claim 1 further comprising a plurality of struts; said plurality of struts being affixed to and reinforcing one or more of the connections between: (i) said tube and said shaft; (ii) said shaft and said horizontal member; or (iii) said horizontal member and said diagonal member.

* * * * *